US011242640B2

(12) United States Patent
Murphy

(10) Patent No.: US 11,242,640 B2
(45) Date of Patent: Feb. 8, 2022

(54) HOUSEHOLD APPLIANCE WITH SINGLE-USE DISPENSER FOR BULK DISPENSER FILLING

(71) Applicant: WHIRLPOOL CORPORATION, Benton Harbor, MI (US)

(72) Inventor: Sayer J. Murphy, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 135 days.

(21) Appl. No.: 16/708,981

(22) Filed: Dec. 10, 2019

(65) Prior Publication Data

US 2020/0208328 A1 Jul. 2, 2020

Related U.S. Application Data

(60) Provisional application No. 62/786,571, filed on Dec. 31, 2018.

(51) Int. Cl.

| | |
|---|---|
| ***D06F 39/02*** | (2006.01) |
| ***A47L 15/42*** | (2006.01) |
| ***D06F 39/08*** | (2006.01) |
| ***A47L 15/44*** | (2006.01) |

(52) U.S. Cl.

CPC ..... *D06F 39/02* (2013.01); *A47L 15/4217* (2013.01); *A47L 15/449* (2013.01); *A47L 15/4463* (2013.01); *D06F 39/088* (2013.01)

(58) Field of Classification Search

CPC .... D06F 39/02; D06F 39/088; A47L 15/4217; A47L 15/449; A47L 15/4463

See application file for complete search history.

(56) References Cited

U.S. PATENT DOCUMENTS

| | | | | |
|---|---|---|---|---|
| 8,240,514 | B2 | 8/2012 | Livingston et al. | |
| 8,397,544 | B2 | 3/2013 | Hendrickson | |
| 8,763,856 | B2 | 7/2014 | Livingston et al. | |
| 9,725,844 | B2 | 8/2017 | Livingston et al. | |
| 10,253,444 | B2 | 4/2019 | Ayers et al. | |
| 2018/0023237 | A1* | 1/2018 | Ayers | D06F 39/022 68/12.18 |

FOREIGN PATENT DOCUMENTS

GB 2001108 A1 1/1979

OTHER PUBLICATIONS

Diverter valves https://www.younginds.com/products/diverter-valves/pneumatic-conveying/model-b/ (Year: 2016).*

ZME Science "The Pythagorean cup—the vessel that spills its content if you're too greedy" by Tibi Puiu, Nov. 10, 2015.

* cited by examiner

*Primary Examiner* — Michael E Barr

*Assistant Examiner* — Pallavi Chitta

(74) *Attorney, Agent, or Firm* — McGarry Bair PC

(57) ABSTRACT

A household appliance, such as a fabric treating appliance and/or a dish treating appliance, incorporating both a bulk dispensing system and a single-use dispensing system, with a single-use dispensing cup having an output that is selectively coupled to one of a treating chamber of the appliance or a bulk treating chemistry reservoir of the bulk dispensing system.

16 Claims, 3 Drawing Sheets

HOUSEHOLD APPLIANCE WITH SINGLE-USE DISPENSER FOR BULK DISPENSER FILLING

CROSS-REFERENCE TO RELATED APPLICATIONS

This application claims the benefit of U.S. Provisional Patent Application No. 62/786,571, filed Dec. 31, 2018.

BACKGROUND

Household appliances, especially fabric treating appliances and dish treating appliances, are more and more incorporating both bulk dispensing systems in combination with the more traditional single-use dispensing system. Because of appliance industry cabinet size standards and historical product configurations, it has been difficult to find user-accessible space in the cabinet for a bulk reservoir of the bulk dispensing system. Typically, the bulk reservoir is located remotely in the cabinet at a non-user accessible location, leading to the need of a user-accessible filling port for the remotely located bulk reservoir.

Given the limited available space, it is difficult to find a suitable space for the user-accessible filling port. A common solution for the user-accessible filling port is to dedicate one of the single-use cups of the user-accessible dispenser for filling the remote bulk reservoir and/or reducing the size of the single-use dispenser and using the extra space for a dedicated filling port for the bulk reservoir. Either approach reduces the functionality of the single-use dispensing system because typically one less treating chemistry can be dispensed from it.

The problem of where to locate the bulk reservoir filling port and the single-use dispenser is being made more difficult in that consumer demands are leading to larger capacity machines with more cycle functionality and more ancillary functionality, like integrated stain stations, which further reduces the available space in the cabinet for the either the single-use or bulk dispensing systems.

BRIEF SUMMARY

In one aspect, the disclosure relates to a household appliance comprising: a treating chamber; a household water supply fluidly coupled to the treating chamber; a bulk dispenser fluidly coupled to the treating chamber and having a bulk treating chemistry reservoir; a single-use dispenser fluidly coupled to the treating chamber and having a single-use dispensing cup having a siphon, a first outlet fluidly coupled to the bulk treating chemistry reservoir, and a second outlet fluidly coupled to the treating chamber, and a diverter selectively fluidly coupling the siphon to the first and second outlet.

In another aspect, the disclosure relates to a household appliance comprising a treating chamber, a household water supply, a bulk dispenser fluidly coupled to the treating chamber and having a bulk treating chemistry reservoir, a single-use dispensing cup having a siphon, an inlet fluidly coupled to the household water supply, a first outlet fluidly coupled to the bulk treating chemistry reservoir, and a second outlet fluidly coupled to the treating chamber, a diverter selectively fluidly coupling the siphon to the first and second outlet, and a biasing device normally biasing the diverter to fluidly couple the siphon to the first outlet, wherein, when water flows into the inlet from the household water supply, the force of the flowing water selectively overcomes the biasing device and moves the diverter to fluidly couple the siphon to the second outlet.

In yet another aspect, the disclosure relates to a method of operating a household appliance having a treating chamber and a single-use dispenser with a siphon, the method comprising fluidly coupling the siphon to the treating chamber when supplying water to a single-use dispenser, and fluidly coupling the siphon to a bulk treating chemistry reservoir when water is not supplied to the single-use dispenser.

DETAILED DESCRIPTION

Figure 1:
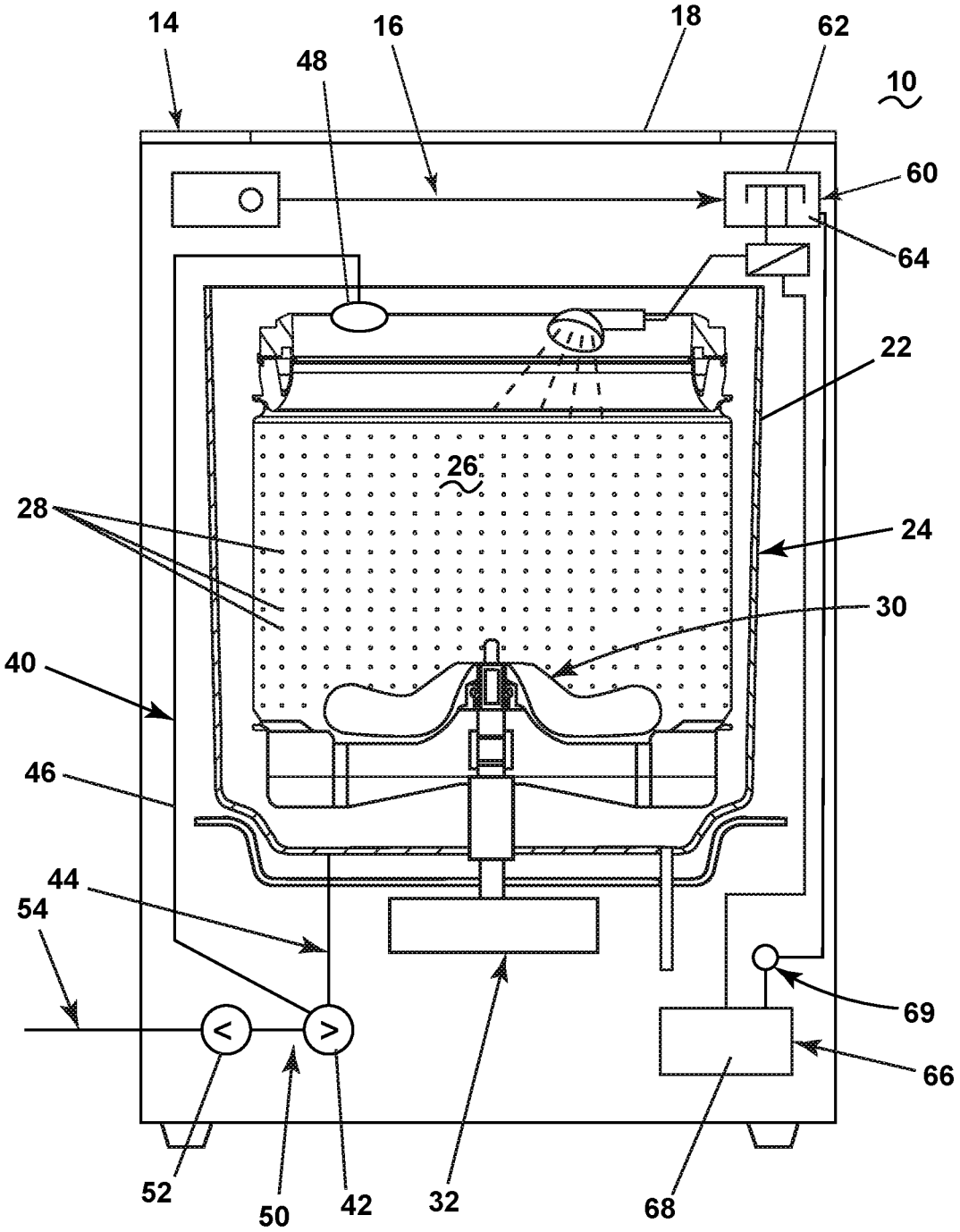
FIG. 1 is a schematic front view of a household appliance in the form of a vertical axis washing machine having a single-use dispensing cup that is selectively fluidly coupled to a treating chamber of the appliance or a bulk treating chemistry reservoir.

FIG. 1 illustrates a laundry treating appliance in the form of a top-loading, vertical axis washing machine 10 incorporating a single-use dispenser capable of filling a bulk reservoir of a bulk dispenser. The vertical axis washing machine 10 comprises a chassis, illustrated as a cabinet 14, defining an interior 16 accessible through a top door 18. A tub 22 is located within the interior 16 and defines a fluid tank for holding water, wash liquid, and the like. A basket 24 is located within and rotatable relative to the tub 22. The basket 24 defines a treating chamber 26 for receiving laundry, such as clothes, for treatment. The basket 24 can have drain holes, such as perforations 28, through which liquid can pass to and from the tub 22.

A clothes mover shown as an impeller 30 is located within the treating chamber 26 and is rotationally driven by a motor 32, which can also rotate the basket 24. The impeller 30 is one example of a suitable clothes mover. Other clothes movers like an agitator, auger, nutator, etc. are contemplated.

A household water supply 36 is provided and supplies water, hot or cold, to the treating chamber 26 directly or indirectly to the treating chamber 26 and other systems of the laundry treating appliance.

A fluid recirculation circuit 40 is provided to recirculate liquid into the treating chamber 26. The recirculation circuit 40 comprises a recirculation pump 42 that is supplied by a sump or sump line 44 that is fluidly coupled to the tub 22. An output line 46 receives liquid from the recirculation pump 42 and returns the liquid to the treating chamber 26. A spray head 48 or some other type of distribution device or nozzle can be located on the end of the output line 46.

A fluid drain circuit 50 is provided to drain liquid from the treating chamber 26. The drain circuit 50 comprises a drain pump 52 that is supplied by the sump or sump line 44. A drain line 54 receives liquid from the drain pump 52 and sends the liquid to a household drain.

A dispensing system 60 is provided for dispensing treating chemistry to the treating chamber 26. The dispensing system 60 comprises a single-use dispenser 62 with at least one dispensing cup 64 and a bulk dispenser 66 with a bulk reservoir 68. The single-use dispenser 62 dispenses a single dose or charge of treating chemistry from the dispensing cup 64, which the user supplies contemporaneously as part of the execution of the cycle of operation. The bulk dispenser 66 dispenses a charge of treating chemistry from the bulk reservoir 68 in response to the execution of the cycle of operation. A metering pump 69 can be included with the bulk dispenser 66 to control the amount of chemistry dispensed from the bulk reservoir 68. The user need not fill the bulk reservoir 68 for each cycle of operation, but only needs to fill the bulk reservoir 68 on a periodic or as-needed basis. The bulk reservoir 68 holds multiple charges of treating chemistry.

Figure 2:
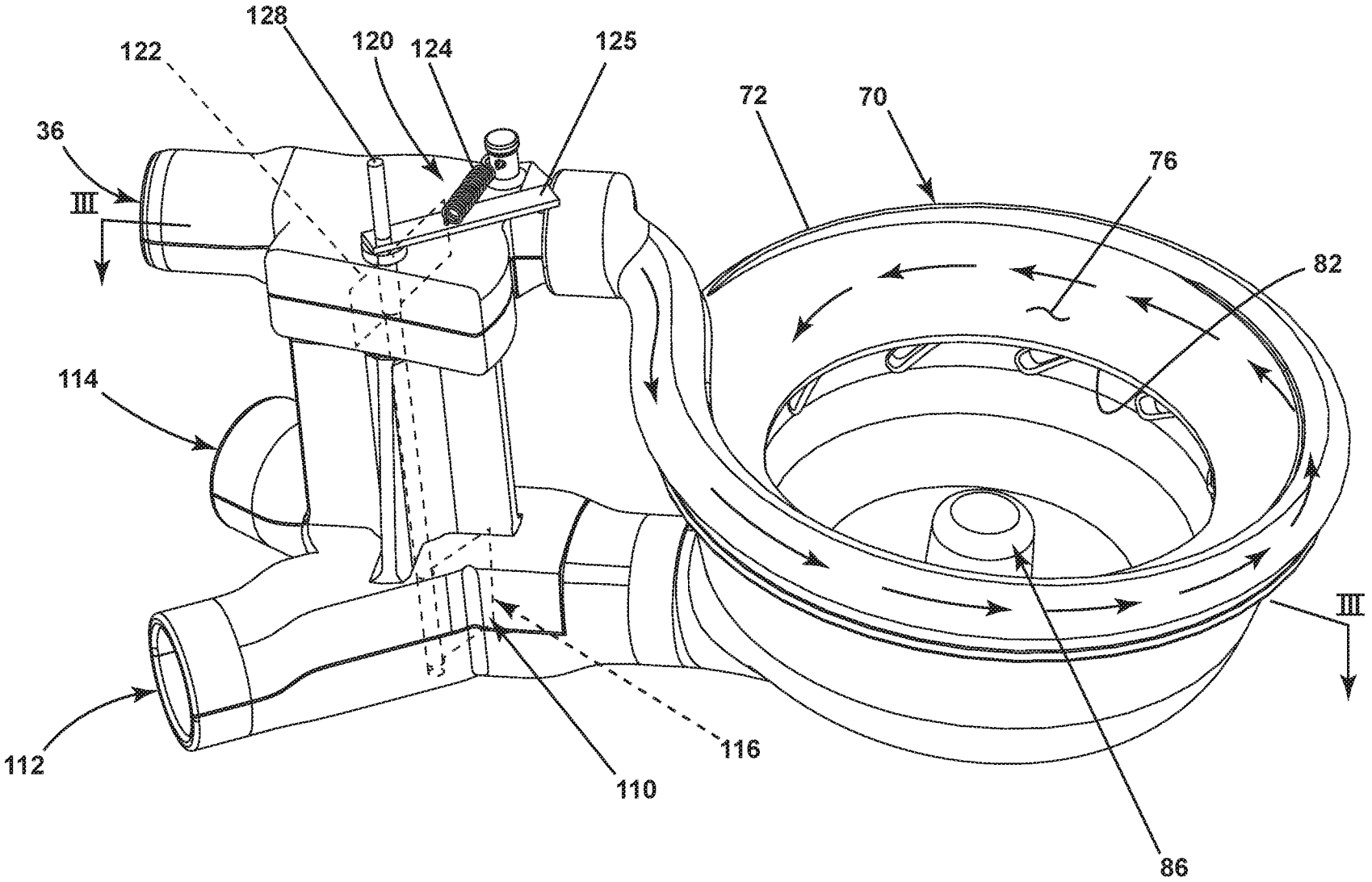
FIG. 2 is a perspective view of one possible implementation of the single-use dispensing cup of FIG. 1.

Referring to FIG. 2, the dispensing cup 64 is in the form of a bowl 70 with a rim 72 defining a fill opening 76 to an interior or chamber 78 formed by the bowl 70. The rim 72 extends inwardly and downwardly, to form a water supply channel 82 that is open to the chamber 78 and which is fluidly connected to the household water supply 36, whereby water supplied to the bowl 70 from the household water supply 36 circumferentially traverses the bowl 70 as it enters the chamber 78, which provides the water with a swirl-like path, as indicated by the arrows, that advantageously cleans the bowl as the water enters the chamber 78.

Figure 3:
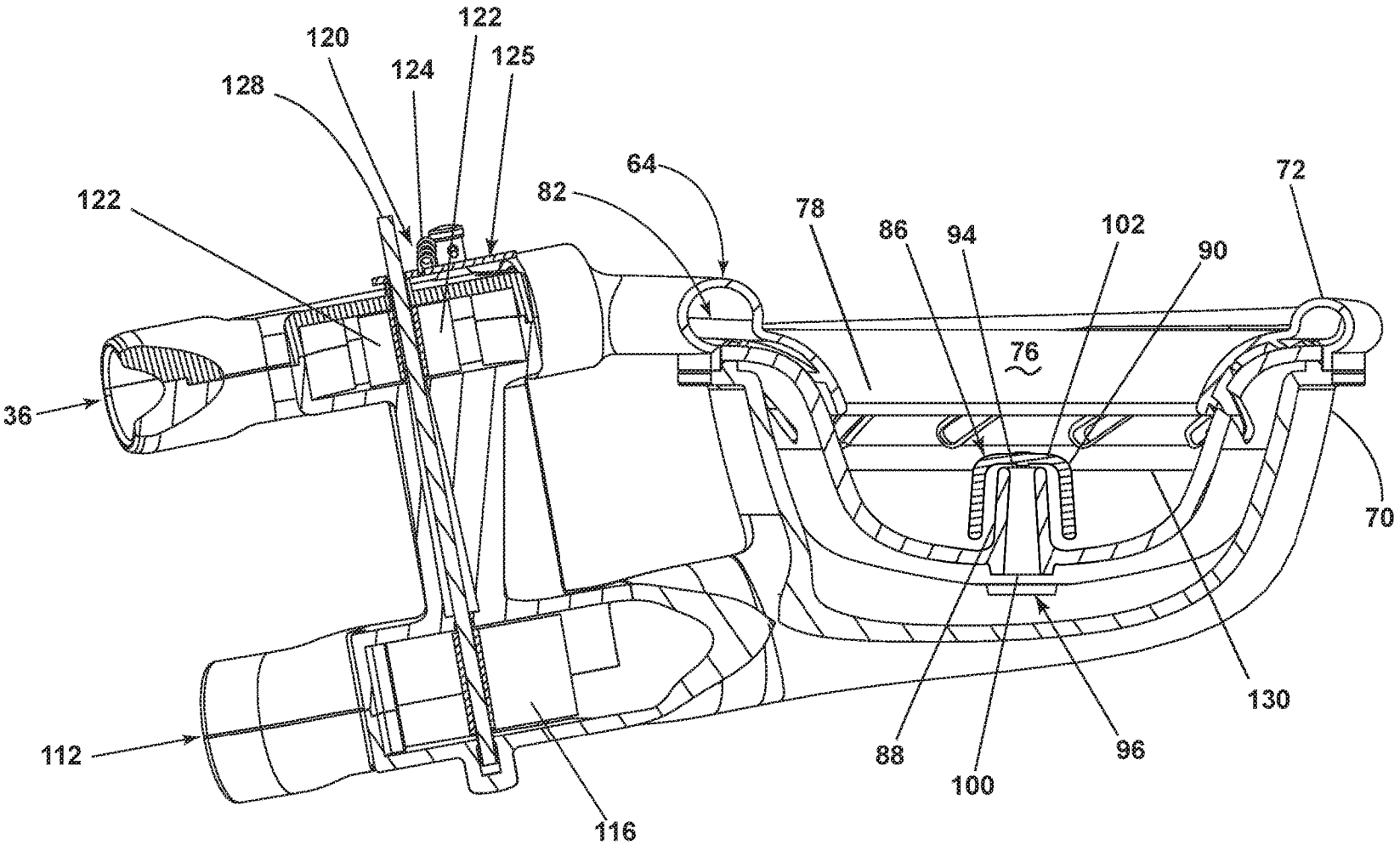
FIG. 3 is a sectional view taken along line 3-3 of FIG. 2.

Referring to FIG. 3, a siphon 86 extends upwardly from a bottom of the bowl 70 and includes a standpipe 88 with an overlying cap 90. The standpipe 88 includes an inlet 94 at an upper end and an outlet 96 at a lower end. The cap 90 is sized to define an annular gap 100 between the cap 90 and the standpipe 88, with a tip space 102 at the inlet 94.

A diverter assembly 110 is fluidly coupled to the outlet 96 of the standpipe 88 and has a first line 112 fluidly coupled to the bulk reservoir 68 and a second line 114 fluidly coupled to the treating chamber 26. A diverter 116 is located at the junction of the first and second lines 112, 114 and is operably coupled between a first state where the outlet 96 is fluidly coupled to the first line 112, but closed to the second line 114, and a second state wherein the outlet 96 is fluidly coupled to the second line 114, but closed to the first line 112. In this way, the operation of the diverter 116 between the first and second states selectively fluidly couples the outlet of the siphon to the bulk reservoir 68 or the treating chamber 26, respectively.

The diverter assembly 110 further comprises an actuator 120 that is illustrated as a vane 122 located within the household water supply 36. A spring 124 biases the vane 122 to a normal position wherein the vane 122 at least partially closes the household water supply 36 and moves to a diverting position in response to water passing through the household water supply 36 to the chamber 78. The vane 122 is coupled by a shaft 128 to the diverter 116, such that when the vane 122 moves from the normal position to the diverting position, the diverter moves from the first state to the second state. The spring 124 is coupled to the shaft by an arm 125.

In this way, the flow of water from the household water supply controls the actuation of the diverter 116 to control the destination of the treating chemistry poured into the cup 64. This is beneficial in being able to use the cup 64 to fill the bulk reservoir 68 or supply the treating chemistry to the treating chamber 26. For example, when it is desired to fill the bulk reservoir 68, a user pours the treating chemistry into the chamber 78. Once the treating chemistry reaches the tip space 102, the liquid is siphoned by into the inlet 94 of the standpipe 88 and then exits the outlet 96 to the diverter 116. As there is no water flowing into the dispensing cup 64, the vane 122 is in the normal position and the diverter 116 diverts the liquid to the first line 112 connected to bulk reservoir 68 to fill the bulk reservoir 68. The continued filling of the dispensing cup 64 results in the continued filling of the bulk reservoir 68.

If it is desired to use the dispensing cup 64 for a single-use operation, the user merely fills the dispensing cup to a fill line 130, which is below the inlet 94 to the standpipe 88, which prevents the siphoning of the treating chemistry. When the user starts the operation of the household appliance, water is supplied to the dispensing cup from the household water supply 36, which moves the vane 122 from the normally closed position to the diverting position, which moves the diverter 116 to divert the liquid exiting the outlet of the standpipe 88 to the second line 114 to supply the mixture of treating chemistry and water to the treating chamber 26. When the water supply is stopped, the vane 122 is returned by the spring 124 to the normal position and the diverter 116 is moved to fluidly connect the siphon outlet 96 to the first line 112.

As the normal operation of the household appliance results in water only being supplied during the execution of a cycle of operation, this anticipated operation can be relied on enable the use of a single dispensing cup to supply treating chemistry to the treating chamber or to fill the bulk reservoir.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention claimed is:

1. A household appliance comprising:

a treating chamber;

a household water supply fluidly coupled to the treating chamber;

a bulk dispenser fluidly coupled to the treating chamber and having a bulk treating chemistry reservoir;

a single-use dispenser fluidly coupled to the treating chamber and having a single-use dispensing cup having a siphon, a first outlet fluidly coupled to the bulk treating chemistry reservoir, and a second outlet fluidly coupled to the treating chamber; and a diverter selectively fluidly coupling the siphon to the first and second outlet, wherein the diverter has a normal position, where the siphon is fluidly coupled to the first outlet, and a diverted position, where the siphon is fluidly coupled to the second outlet.

2. The household appliance of claim 1 wherein the diverter is operably coupled to the household water supply such that the supplying of water through the household water supply moves the diverter from the normal position to the diverted position.

3. The household appliance of claim 1 wherein the household water supply is fluidly coupled to the single use dispensing cup and operably coupled to the diverter wherein supplying of water through the household water supply to the single-use dispensing cup fluidly couples the siphon to the second outlet.

4. The household appliance of claim 1 wherein the single-use dispensing cup terminates in a rim to define an open-top chamber.

5. The household appliance of claim 4 further comprising a water supply channel extending along the rim and fluidly coupling the household water supply to the chamber.

6. The household appliance of claim 1 further comprising a vane operably coupled to the diverter and fluidly coupled to the household water supply, whereby water flowing through the household water supply moves the vane to move the diverter to selectively fluidly couple the diverter to the first and second outlet.

7. The household appliance of claim 6 further comprising a biasing element that biases the vane to a first position, where the siphon is fluidly coupled to the first outlet, and the flow of water through the household water supply moves the vane to a second position, where the siphon is fluidly coupled to the second outlet.

8. The household appliance of claim 7 further comprising a shaft rotationally connecting the vane to the diverter, whereby rotation of the vane effects a rotation of the diverter.

9. A household appliance comprising:

a treating chamber;

a household water supply fluidly coupled to the treating chamber;

a bulk dispenser fluidly coupled to the treating chamber and having a bulk treating chemistry reservoir;

a single-use dispenser fluidly coupled to the treating chamber and having a single-use dispensing cup having a siphon, a first outlet fluidly coupled to the bulk treating chemistry reservoir, and a second outlet fluidly coupled to the treating chamber, the single-use dispensing cup terminating in a rim to define an open-top chamber;

a water supply channel extending along the rim and fluidly coupling the household water supply to the chamber; and a diverter selectively fluidly coupling the siphon to the first and second outlet.

10. The household appliance of claim 9, further comprising a biasing element that biases a vane connected to the diverter to a first position where the siphon is fluidly coupled to the first outlet and wherein, when water flows into the inlet from the household water supply the flowing water moves the vane to a second position where the siphon is fluidly coupled to the second outlet.

11. The household appliance of claim 10 further comprising a vane operably coupled to the diverter and fluidly coupled to the household water supply, whereby water flowing through the household water supply moves the vane to move the diverter to selectively fluidly couple the diverter to the first and second outlet.

12. The household appliance of claim 11 further comprising a shaft rotationally connecting the vane to the diverter, whereby rotation of the vane effects a rotation of the diverter.

13. The household appliance of claim 10 wherein the single-use dispensing cup terminates in a rim to define an open-top chamber.

14. The household appliance of claim 13 further comprising a water supply channel extending along the rim and fluidly coupling the household water supply to the chamber.

15. The household appliance of claim 10 wherein the diverter has a normal position, where the siphon is fluidly coupled to the first outlet, and a diverted position, where the siphon is fluidly coupled to the second outlet.

16. The household appliance of claim 15 wherein the diverter is operably coupled to the house hold water supply such that the supplying of water through the household water supply moves the diverter from the normal position to the diverted position.

* * * * *